United States Patent [19]

Powers et al.

[11] Patent Number: 4,566,008

[45] Date of Patent: Jan. 21, 1986

[54] FAULT DETECTING CIRCUIT AND METHOD FOR A VEHICLE DETECTOR SYSTEM

[75] Inventors: Avery W. Powers, Scottsdale; Guy L. Cates, Mesa; Charles W. Staats, Jr.; Jarrell W. Mullies, both of Tempe, all of Ariz.

[73] Assignee: Solid State Devices, Inc., Tempe, Ariz.

[21] Appl. No.: 393,452

[22] Filed: Jun. 29, 1982

[51] Int. Cl.[4] ..... G08G 1/01

[52] U.S. Cl. ..... 340/941; 324/226; 340/933; 340/515

[58] Field of Search ..... 340/941, 933, 938, 515, 340/931; 324/202, 226, 225, 236; 331/1 A

[56] References Cited

U.S. PATENT DOCUMENTS

| | | | |
|---|---|---|---|
| 3,571,789 | 3/1971 | Midlock | 340/941 |
| 3,753,260 | 8/1973 | Nelkin | 340/515 |
| 3,875,525 | 4/1975 | Ballinger | 340/933 |
| 4,302,746 | 11/1981 | Scarzello | 340/941 |

OTHER PUBLICATIONS

*IBM Technical Disclosure Bulletin*, French, vol. 8, No. 1, Jun. 1965, p. 71.

*Primary Examiner*—James J. Groody
*Attorney, Agent, or Firm*—Weiss & Holloway

[57] ABSTRACT

Apparatus and method for a circuit which is connected in series between the call signal output of a vehicle detector and the call signal input of a traffic controller is disclosed. Under normal operating conditions the invention acts as a signal buffer and input of the invention will be applied to the input of the traffic controller when call signal inputs are continuously present or not present for preestablished times, then test procedures are implemented. During a test or failure condition of the vehicle detector, the detector output signal will be disconnected from the controller. The invention also provides a circuit which is connected between the loop and the loop input of the vehicle detector. The circuit along with the accompanying method is designed to modify the input impedance to the vehicle detector to apply a test or "forced" call signal to the vehicle detector input when a call signal input is not received after a predetermined period of time, a fault condition is established. Indicators display the operating states of the call signal output to the controller and/or the fault mode of the vehicle detector in the event of a fault condition. Apparatus is available for providing a synthetic call signal for use in controlling traffic in the event of selected apparatus failures.

40 Claims, 7 Drawing Figures

FAULT DETECTING CIRCUIT AND METHOD FOR A VEHICLE DETECTOR SYSTEM

BACKGROUND OF THE INVENTION

The present invention relates to vehicle detector monitors and methods. More particularly, the present invention relates to the field of traffic control systems in which vehicle detectors are used to determine the presence of vehicles at predetermined locations along a roadway or at an intersection or crossing within a specified control zone. Signals from the vehicle detectors are applied to a traffic controller to advise the controller of the presence of vehicles at those particular locations. This allows the traffic controller to permit all movements of traffic at an intersection or crossing to pass through that crossing in a safe and orderly fashion.

The use of traffic signal lights to control the flow of traffic, particularly at the intersection of two or more streets or highways, is well known. The traffic signal lights controlling traffic at an intersection are typically controlled by a local traffic controller which is programmed to produce command signals which are ultimately applied to the traffic signal lights. To control the various movements of traffic at an intersection, the traffic controller relies on "Call" signals sent to it from the vehicle detectors to determine the presence of vehicles at various key locations at the intersection. This information in the form of call signals from the vehicle detectors allows the controller to cycle the traffic signal lights at the intersection in a logical and orderly fashion. By allowing traffic movements only where needed, optimum traffic flow will be maintained.

The vast majority of vehicle detectors presently in use are referred to as "loop" detectors. These devices utilize a coil or loop of wire embedded under the road surface to provide the signal input to the detector. When a vehicle passes over the loop, the inductance of the loop is changed, and the vehicle detector senses this inductance change and provides a "call" signal output to the controller. A common problem with this type of detector is that the loop will either short circuit across itself or break open due to the abuse it is subject to while embedded under the road surface. For this reason, the loop or input device needs to be tested. Moreover, the vehicle detector itself is also subject to mechanical or electrical failure.

Typically, a vehicle detector and sensor combination will fail in one of two modes. Either the detector will fail in such a way as to cause its output to stay "on" continuously, which provides a continuous "call" signal to the controller whether there is a vehicle present at that detector location or not, or the detector will fail in such a way as to cause its output to stay "off" continuously, which will not place a "call" signal to the controller when a vehicle is present at that detector location.

The first mode of failure above-described may cause the traffic controller to continually cycle to that particular movement of traffic where the vehicle detector has failed, and may allow that movement its maximum allowable time even though there may be little or no traffic there. This ultimately takes away from time which would be allotted to other traffic movements and could cause traffic congestion.

The second mode of failure is potentially the most hazardous. After the vehicle detector fails to provide a "call" signal when a vehicle is present, the controller may never cycle to that movement of traffic to allow it to proceed through the intersection. In this situation, the driver of the vehicle may proceed through the intersection at his own discretion against a red signal output from the controller. This is potentially hazardous to the driver himself as well as other drivers at the intersection, and may be an unavoidable situation in the event of this type of failure.

It is, therefore, an object of the present invention to provide an improved fault detecting circuit and method for a vehicle detector system.

It is further an object of the present invention to provide an improved fault detecting circuit and method for a vehicle detector system which provides a monitoring function of a vehicle detector and sensor and gives visual indications of a fault condition.

It is still further an object of the present invention to provide an improved fault detecting circuit and method for a vehicle detector system which can detect shorted and open conditions in a roadway embedded vehicle sensor.

It is still further an object of the present invention to provide an improved fault detecting circuit and method for a vehicle detector system which can disconnect a defective vehicle detector and sensor combination from a traffic controller.

It is still further an object of the present invention to provide an improved fault detecting circuit and method for a vehicle detector system which can automatically supply a synthetic call signal to a traffic controller.

It is still further an object of the present invention to provide an improved fault detecting circuit and method for a vehicle detector system which provides for a self-test function for internal faults.

SUMMARY OF THE INVENTION

The foregoing objects are achieved in the present invention wherein a circuit and method is utilized which is connected in series between the call signal output of a vehicle detector and the call signal input of a vehicle controller. Under normal operating conditions, the invention acts as a signal buffer and any signal input to the invention will be applied to the input of the traffic controller. During a test or a failure condition of the vehicle detector, the detector output signal will be disconnected from the traffic controller. The present invention also provides a circuit and method which is connected between the loop and the loop input of the vehicle detector. This circuitry is designed to modify the input impedance to the vehicle detector to apply a test or "forced" call signal to the vehicle detector input. Indicators are provided to display the operating states of the call signal output to the controller and/or the fault mode of the vehicle detector in the event of a fault condition.

The circuit and method of the present invention will monitor and/or test a vehicle detector for two modes of failure, either "long call" or "no call". The long call mode of failure is defined by design as a continuous call signal which has been applied to the input of the invention for a period of time exceeding 6.82 minutes. This time period is well beyond the time limit specified in Nema Spec TS1-7.2.16 "Modes of Operation" and therefore can be defined to be a vehicle detector failure mode.

The no call mode of failure is determined after a test call signal "forced call" is applied to the input of the vehicle detector by the invention. If a call signal from the vehicle detector is not sensed by the invention for a time period of 1.1 minutes, the invention will apply a test call signal to the input of the vehicle detector, forcing the vehicle detector to place a call signal output. If the invention still does not sense a call from the vehicle detector within 100 milliseconds from the time the forced call signal was initiated (Nema Spec TS1-7.2.18) a no call mode of vehicle detector failure can be defined. During the time the invention is in the no call test mode of operation, the call signal (if received) from the vehicle detector will not be applied to the controller input. This prevents the invention from placing false call signals to the controller.

If either of the long call or no call modes of failure above described is detected by the invention, the signal output from the vehicle detector will be disconnected from the controller input and an internally generated "synthetic call" signal will be applied to the controller input by the invention. This synthetic call signal is selectable for two modes of operation, either continuous or pulsed. In the continuous mode, a continuous call signal will be applied to the controller input. In the pulse mode, a 500 millisecond call signal will be applied to the controller input every 15 seconds. If the synthetic call signal is not desired, a synthetic call disable input to the invention is provided. If at any time during normal operation the output signal does not correspond to the input signal, an internal fault will be defined for the invention.

BRIEF DESCRIPTION OF THE DRAWINGS

The above-mentioned and other features and objects of this invention, and the manner of attaining them will become more apparent, and the invention itself will be best understood by reference to the following description of a specific embodiment of the invention taken in conjunction with the accompanying drawings wherein.

DESCRIPTION OF A SPECIFIC EMBODIMENT

System Interconnection

Figure 1:
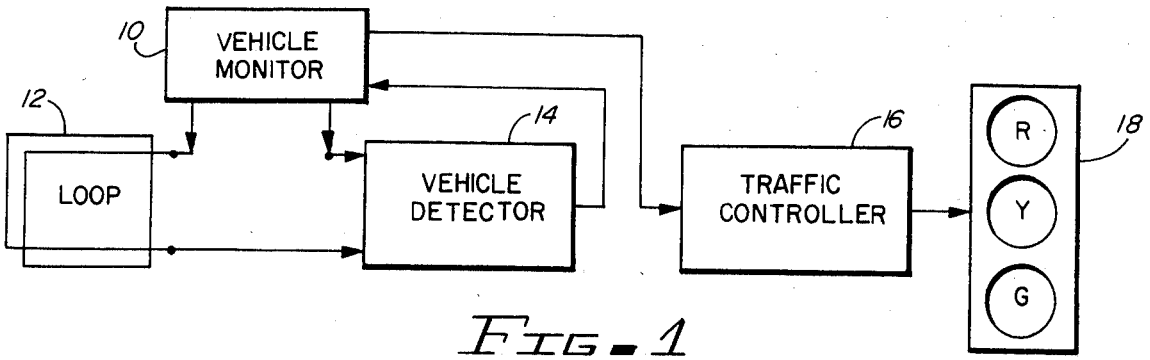
FIG. 1 is a simplified block diagram of a single channel vehicle detection and control system showing the interconnection of the vehicle detection monitor of the present invention.
Figure 3D:
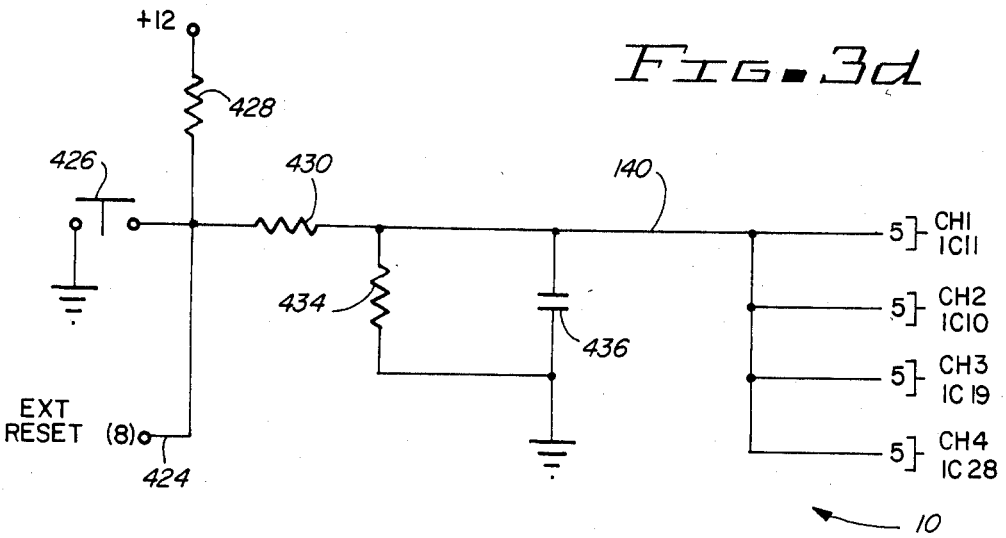
FIGS. 3A–3E are a detailed schematic representation of the vehicle detector monitor of FIG. 2.
Figure 3E:
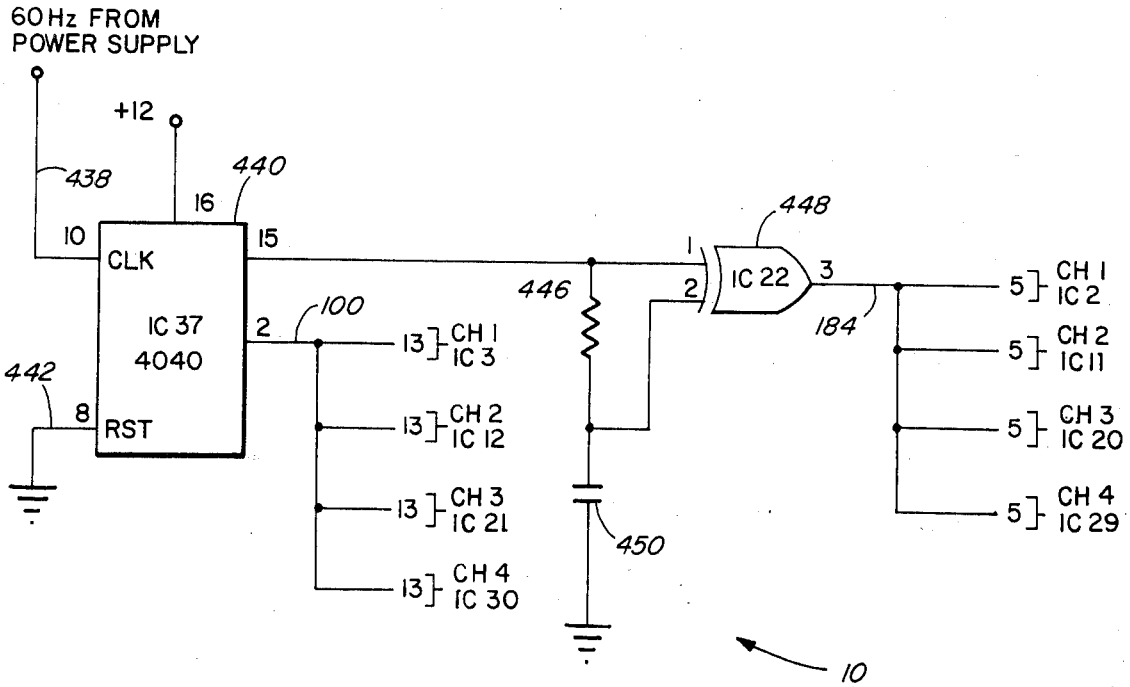

Referring now to FIG. 1, the vehicle detector monitor 10 of the present invention is shown as connected to a conventional vehicle detection and traffic control system comprising a loop 12, a vehicle detector 14, a traffic controller 16 and a traffic signal 18. As shown, the vehicle detector monitor 10 is connected in series between the call signal output of the vehicle detector 14 and the call signal input of the traffic controller 16. Additionally, vehicle detector monitor 10 is connected between loop 12 and the loop input of vehicle detector 14 such that vehicle detector monitor 10 can modify the input impedance to vehicle detector 14 to apply a test or forced call input to the vehicle detector 14 input.

Overall System Description And Operation

Figure 2:
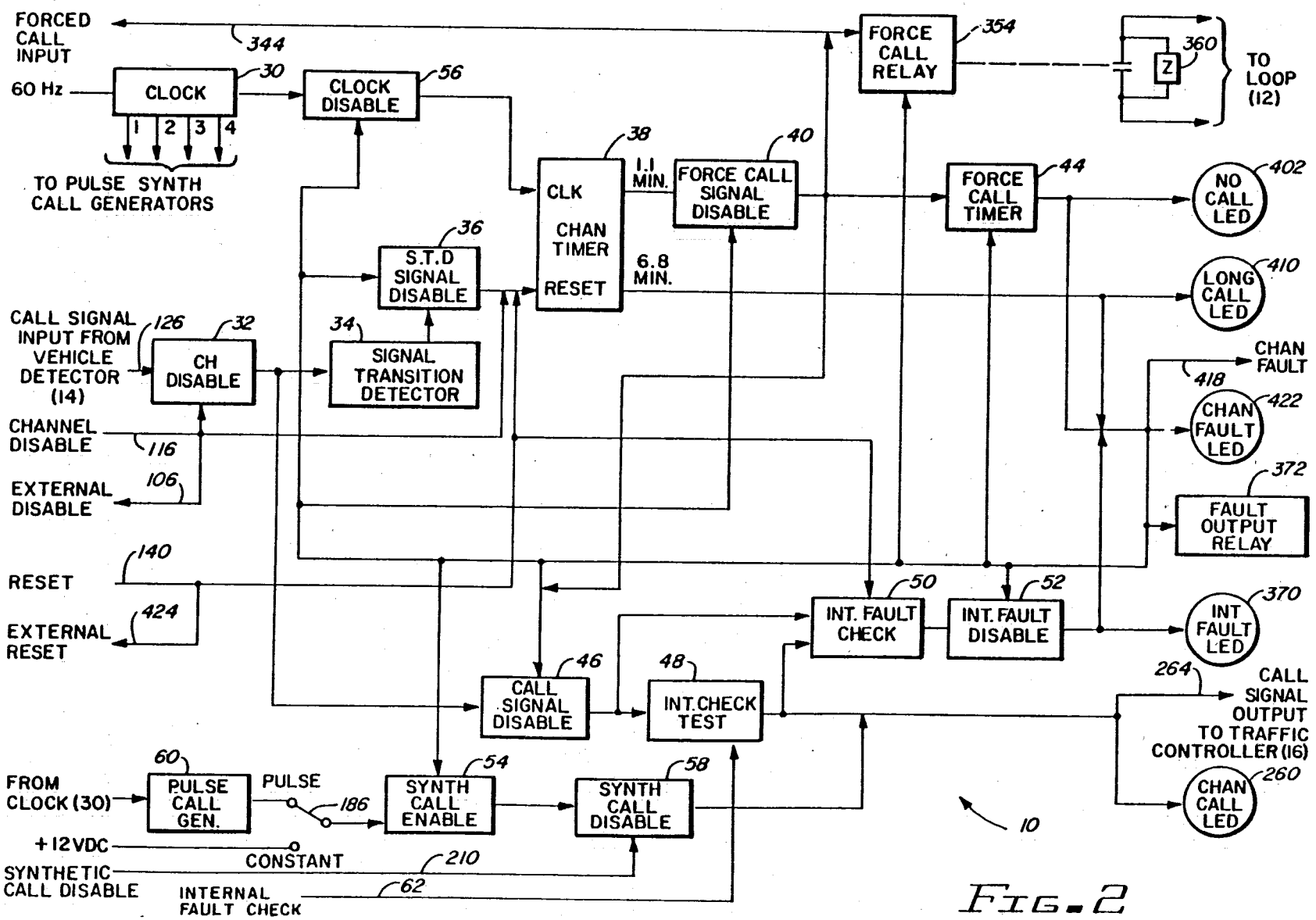
FIG. 2 is a simplified block diagram of a specific embodiment of the vehicle detector monitor of the present invention for use in the system depicted in FIG. 1.
Figure 3A:
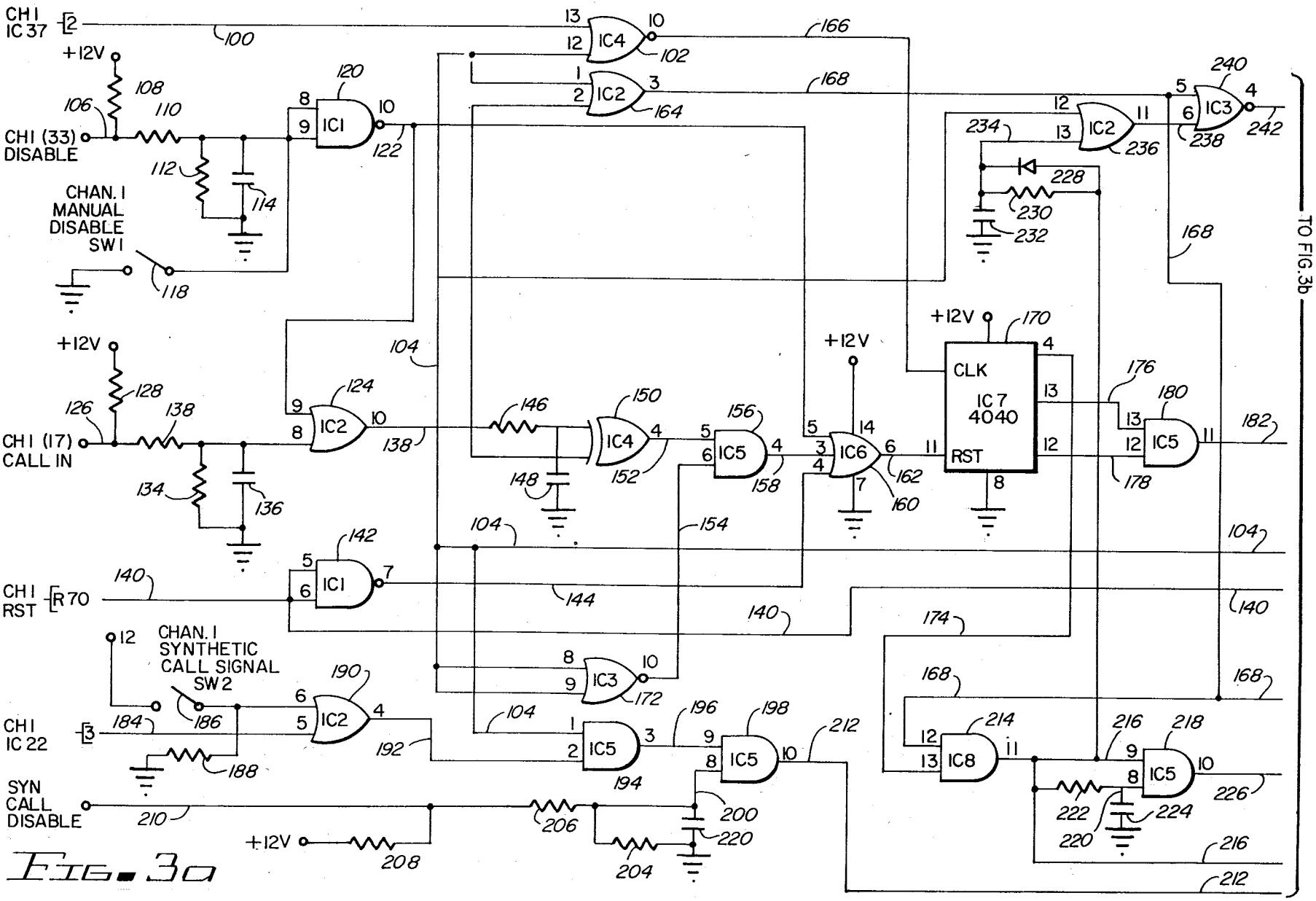
Figure 3B:
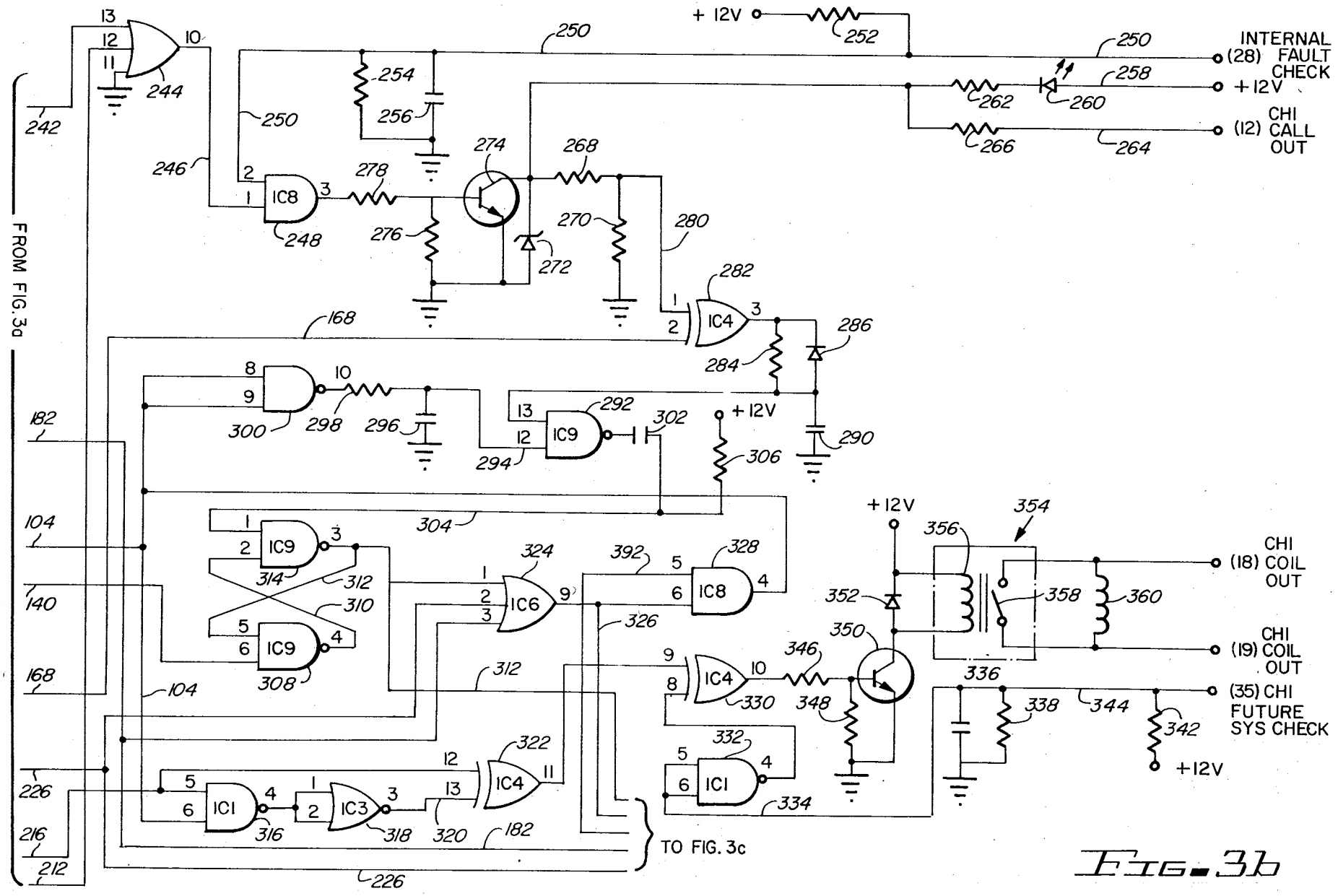
Figure 3C:
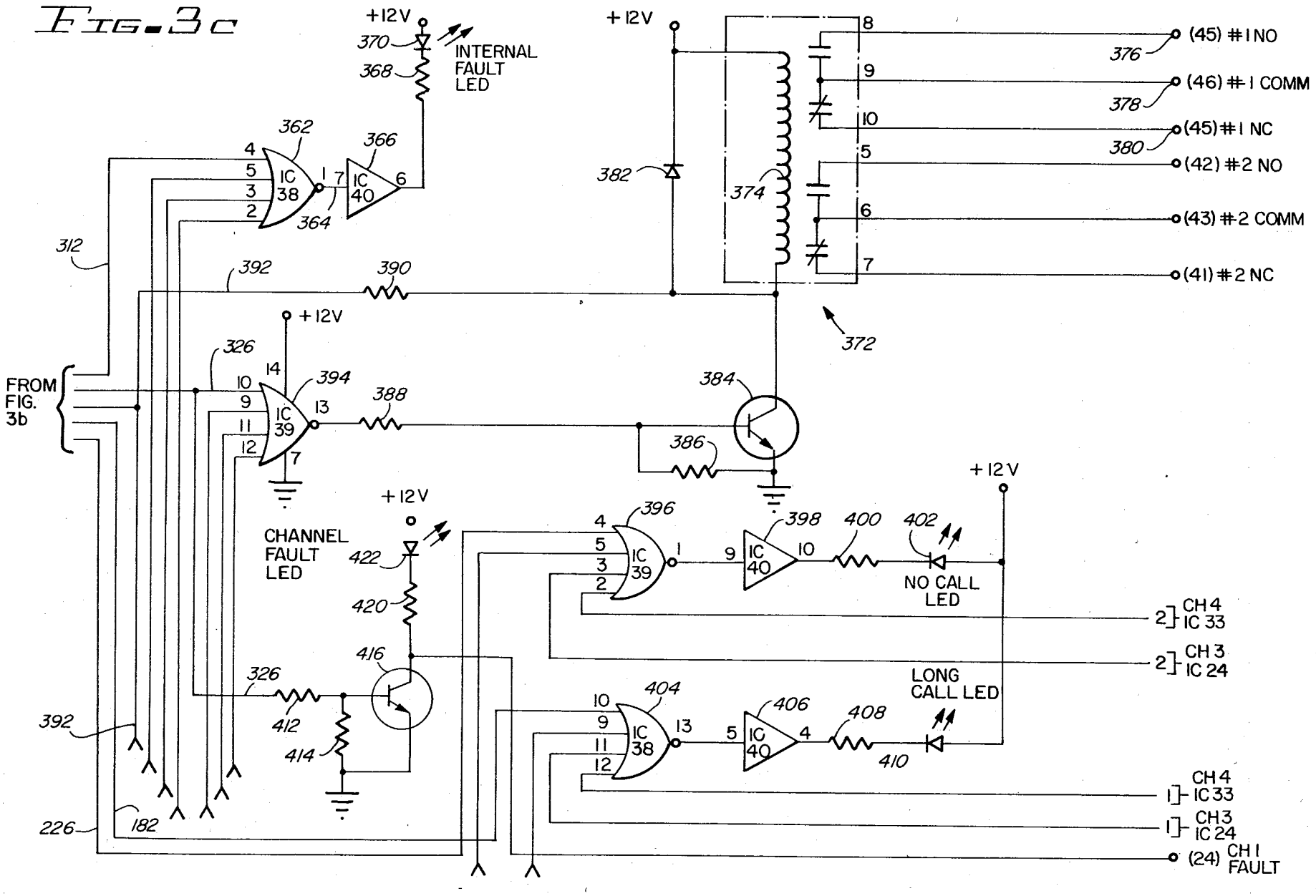

Referring additionally now to FIG. 2, a simplified block diagram of a specific embodiment of the vehicle detector monitor 10 of the present invention is shown.

Long Call Mode of Operation

Upon receiving a call signal from vehicle detector 14, a logic low is transferred through the overridden channel disable circuit 32 to the following circuit functions: the signal transition detector 34, the signal transition detector disable circuit 36, the channel timer 38, the force call signal disable circuit 40, the call signal disable circuit 46 and the internal check test circuit 48. When a transition from receiving an absence of a call signal to that of receiving a call signal is applied to the signal transition detector 34, a positive spike is produced and transferred through an overridden signal transition detector disable circuit 36 to reset the channel timer 38. The presence of a call signal prevents the no call test by disabling the forced call signal at the forced call signal disable circuit 40.

The call signal is transferred through the overridden call signal disable circuit 46 and the internal check test circuit 48 to the call signal output on call out line 264 to traffic controller 16. The call signal also illuminates channel call LED 260. If the call signal remains for more than 6.82 minutes, the channel timer 38 will output a signal to illuminate long call LED 410 and fault LED 422 as well as deenergize the fault output relay 372.

No Call Mode Of Operation

When an absence of a call signal is detected on call in line 126, a logic high is applied through the overridden channel disable circuit 32 to the following circuit functions: the signal transition detector 34, the signal transition detector disable circuit 36, the channel timer 38, the forced call signal disable circuit 40, the synthethic call enable circuit 54 and the synthetic call disable circuit 58. When a transition from receiving a call signal to an absence of a call signal is applied to signal transition detector 34, a positive spike is produced and is transferred through the overridden signal transition detector disable circuit 36 to reset channel timer 38. The absence of a call signal will override the forced call signal disable circuit 40 and will allow the no call test to be initiated at the predetermined time. The absence of a call signal is transferred through the overridden call signal disable circuit 46 and the internal check test circuit 48 to the call signal output appearing on call out line 264 to traffic controller 16.

If the state of having an absence of a call signal remains for 1.1 minutes, the channel timer 38 will output a signal through the overridden forced call signal disable circuit 40 to energize the forced call relay 354, and initialize forced call timer 44 and the call signal circuit 46. When the forced call relay 354 energizes, it induces on loop 12 a significant amount of change in the magnitude of the connected impedance to place a call on vehicle detector 14. This forced call signal on call in line 126, a logic low, is transferred through the overridden channel disable circuit 32 to signal transition detector 34 and signal transition detector disable circuit 36 which upon the signal transition resets channel timer 38, which in turn, deenergizes forced call relay 354 and resets forced call timer 44 before it can initiate a fault. At the release of the forced call signal, a logic high is then felt at the input to the signal transition detector 34 which will reset channel timer 38 as described above and reinitialize the no call test timing sequence again.

If the forced call signal on call in line 126 is not received back from vehicle detector 14 within 100 milliseconds channel timer 38 will produce a signal to illuminate no call LED 402 and fault LED 422 as well as deenergize fault output relay 372.

Internal Fault Check Mode Of Operation

Upon sensing a call signal on the output of the overridden call signal disable circuit 46 the internal fault check circuit 50 must sense a call signal on the call signal output appearing on call out line 264 within 25 milliseconds or it will output a fault signal through the overridden internal fault disable circuit 52 to illuminate internal fault LED 370, fault LED 422 as well as deenergize fault output relay 372.

Channel Fault Mode Of Operation

Upon initiation of a channel fault, a feedback signal will latch the channel in its fault condition until reset. This is done by initializing: the forced call relay disable during a no call fault mode, the internal fault disable circuit 52, the call signal disable circuit 46, the signal transition detector disable circuit 36, the clock disable circuit 56, the forced call timer 44 and the synthetic call enable circuit 54.

Synthetic Call Signal Mode Of Operation

Upon initiation of a fault, a synthetic call signal is transferred through an initialized synthetic call enable circuit 54 and the overridden synthetic call disable circuit 58 and is summed onto the call signal output appearing on call out line 264. A selection of a pulsed synthetic signal or a constant synthetic signal is made by switch 186. The pulsed synthetic signal supplied by the pulse call generator 60 is a 500 millisecond synthetic call signal applied every 15 seconds. By initializing the synthetic call disable circuit 58, the output of a synthetic call signal is prevented on call out line 264 after a fault has occurred.

Other System Modes Of Operation

By applying a reset signal on either reset line 140 or external reset line 424, the internal fault check circuit 50 and channel timer 38 will be reset. Applying a test signal on factory test line 62 will initialize internal check test circuit 48 thereby disabling the call signal output on call out line 264. Applying a forced call signal on system check line 344 will energize the forced call relay 354 and force a call from vehicle detector 14 as above-described in the no call test. Applying a channel select signal on input line 116 will initialize channel disable circuit 32 and put a constant reset on channel timer 38. As shown, clock 30 supplies a clocking input signal to channel timer 38 through clock disable circuit 56 as well as supplying pulses to pulse code generator 60.

DETAILED SYSTEM DESCRIPTION

Referring additionally now to FIGS. 3A–3E, a detailed schematic representation of the vehicle detector monitor 10 of the invention is shown. A signal on line 100 from clock 440 is supplied as one input to NOR gate 102 having as its other input line 104. The output of NOR gate 102 is supplied on clock line 166 to channel timer 170. A channel disable signal on disable line 106 is supplied through resistor 110 to input line 116 to inverter 120. A positive 12 volts is supplied to disable line 106 through resistor 108. An RC network comprising resistor 112 in parallel with capacitor 114 couples input line 116 to circuit ground. Additionally, input line 116 may be connected to circuit ground by means of disable switch 118. The output of inverter 120 appears on line 122 for input to OR gate 124 and tri input OR gate 160. OR gate 124 has as its other input line 132 which receives call inputs on call in line 126 through resistor 130. Resistor 128 couples call in line 126 to a positive 12 volts. An RC network comprising resistor 134 and capacitor 136 couples line 132 to circuit ground. The output of OR gate 124 is furnished on line 138 to exclusive OR gate 150. The other input of exclusive OR gate 150 is coupled to line 138 through resistor 146 and is likewise coupled to circuit ground through capacitor 148. OR gate 164 has as inputs signals appearing on lines 104 and 138.

A reset signal appearing on reset line 140 is supplied as input to inverter 142, the output of which is supplied as one input on line 144 to tri-input OR gate 160. The remaining input to tri-input OR gate 160 is supplied on line 158 from the output of AND gate 156 having as inputs lines 152 and 154. An output signal appearing on line 154 is supplied by means of inverter 172 having as its input a signal on line 104. The output of tri-input OR gate 160 is supplied on reset lines 162 for input to channel timer 170.

Channel timer 170 has as outputs lines 174, 176 and 178. Line 174 is supplied as one input to AND gate 214, having as its other input line 168 from the output of OR gate 164. The output of AND gate 214 is supplied as input to OR gate 236 through parallel connected diode 228 and resistor 230 on line 234. Line 234 is coupled to circuit ground through capacitor 232. The output of OR gate 236 appearing on line 238 is supplied as one input to NOR gate 240 having its other input connected to line 168 at the output of OR gate 164.

The outputs of channel timer 170 appearing on lines 176 and 178 are supplied as inputs to AND gate 180 which has its output connected to one input of tri-input OR gate 324.

Pulse call line 184 is supplied as one input to OR gate 190. The other input of OR gate 190 may be connected to a positive 12 volts by means of switch 186. The same input of OR gate 190 is coupled to circuit ground through resistor 188. The output of OR gate 190 on line 192 is supplied as one input to AND gate 194 having its other input connected to line 104. The output of AND gate 194 is supplied on line 196 as one input to AND gate 198. The other input to AND gate 198 on line 200 is coupled to circuit ground through parallel connected capacitor 202 and resistor 204. A synthetic call disable signal appearing on synthetic call disable line 210 is coupled to line 200 through resistor 206. A positive 12 volts is supplied to synthetic call disable line 210 through resistor 208. The output of AND gate 198 on line 212 is supplied as one input to tri-input OR gate 244. A second input of tri-input OR gate 244 is coupled to circuit ground while the remaining input on line 242 appears at the output of NOR gate 240.

The output of AND gate 214 is supplied on line 216 as one input to AND gate 218. Additionally, line 216 is coupled to the other input of AND gate 218 on line 220 through resistor 222. Line 220 is additionally coupled to circuit ground through capacitor 224. The output of AND gate 218 is supplied on line 226 as a second input to tri-input OR gate 324.

The output of tri-input OR gate 224 appearing on line 246 is supplied as one input to AND gate 248, having as its other input an internal fault check signal appearing on internal fault check line 250. Internal fault check line 250 is coupled to a positive 12 volts through resistor 252 and is additionally coupled to circuit ground through the parallel connected RC network comprising resistor 254 and capacitor 256. The output of AND gate 248 is coupled to the base of NPN transistor 274 through resistor 278. The base of NPN transistor 274 is additionally coupled to its emitter and circuit ground through resistor 276. Zener diode 272, having its anode connected to the emitter of NPN transistor 274, has its cathode connected to the collector thereof which is coupled to call out line 264 through resistor 266. Additionally, the collector of NPN transistor 274 is connected to a positive 12 volts appearing on plus 12 volt line 258 through resistor 262 and channel call LED 260. Further, the collector of NPN transistor 274 is supplied as one input to exclusive OR gate 282 through resistor 268. This input of exclusive OR gate 282 is also coupled to circuit ground through resistor 270. A second input to exclusive OR gate 282 is supplied on line 168 at the output of OR gate 164. The output of exclusive OR gate 282 is connected to one input of NAND gate 292 on line 288 through the parallel connected combination of resistor 284 and diode 286. The anode of diode 286 is coupled to circuit ground through capacitor 290. The remaining input to NAND gate 292 is supplied on line 294. A signal on line 294 is supplied as output of inverter 300 as coupled through resistor 298. Line 294 is coupled to circuit ground through capacitor 296. Inverter 300 has as input line 104.

The output of NAND gate 292 is AC coupled to line 304 through capacitor 302. Line 304 is connected to a positive 12 volts through resistor 306. Line 304 is supplied as an input to NAND gate 314 which is connected in a latching configuration with NAND gate 308. The output of NAND gate 308 appearing on line 310 is connected as a second input to NAND gate 314 having its output on line 312 supplied as an input to NAND gate 308. A second input to NAND gate 308 appears on reset line 140. The output of NAND gate 314 supplies a third input to tri-input OR gate 324, the output of which occurs on line 326. Line 326 furnishes one input of AND gate 328, the output of which is supplied on line 104.

Line 104 is supplied as one input to NAND gate 316 having as its other input line 216 appearing at the output of AND gate 214. The output of NAND gate 316 is supplied as input to inverter 318 for input to exclusive OR gate 322 on line 320. Line 216 supplies the remaning input to exclusive OR gate 322.

The output of exclusive OR gate 322 is supplied as one input to exclusive OR gate 330. The remaining input to exclusive OR gate 330 appears as the output of inverter 332 having as input line 334. A signal appearing on line 334 is input from system check line 344 through resistor 340. An RC network comprising resistor 338 and capacitor 336 couples line 334 to circuit ground. Resistor 342 couples system check line 344 to a positive 12 volts. Resistor 346 couples the output of exclusive OR gate 330 to the base of NPN transistor 350. The base of NPN transistor 350 is coupled to its emitter and circuit ground through resistor 348. The collector of NPN transistor 350 is connected to a positive 12 volts through diode 352 connected in parallel with coil 356 of forced call relay 354. Normally open contacts 358 of forced call relay 354 allow a coil 360 to be connected in series with loop 12. Upon the closing of normally open contacts 358, coil 360 is shunted.

The output of NAND gate 314 appearing on line 312 is supplied as one input to QUAD input NOR gate 362. Remaining inputs to QUAD input NOR gate 362 can be connected to comparable lines 312 of other vehicle detector monitors 10. The output of QUAD input NOR gate 362 is applied to line 364 for input to buffer 366. The output of buffer 366 is connected to a positive 12 volts through resistor 368 and internal fault LED 370.

Line 326 at the output of tri-input OR gate 324 is supplied as one input to QUAD input NOR gate 394. The remaining inputs of QUAD input NOR gate 394 may be connected to comparable lines 326 of other vehicle detector monitors 10. The output of QUAD input NOR gate 394 is supplied to the base of NPN transistor 384 through resistor 388. The base of NPN transistor 384 is additionally coupled to its emitter and circuit ground through resistor 386. The collector of NPN transistor 384 is connected to a positive 12 volts through diode 382 in parallel with coil 374 of fault output relay 372. Additionally, the collector of NPN transistor 384 is connected to line 392 for input to AND gate 328 through resistor 390. Fault output relay 372 additionally presents normally open contact 376, common line 378 and normally closed contact 380.

Quad input NOR gate 396 has its one input line 226 appearing at the output of AND gate 218. Additional inputs to QUAD input NOR gate 396 may be supplied from similar lines 226 of additional vehicle detector monitors 10. The output of QUAD input NOR gate 396 is furnished as input to buffer 398. The output of buffer 398 is coupled to a positive 12 volts through resistor 400 and no call LED 402.

QUAD input NOR gate 404 has its one input line 182 appearing at the output of AND gate 180. Additional inputs to QUAD input NOR gate 404 may be supplied from comparable lines 182 of additional vehicle detector monitors 10. The output of QUAD input NOR gate 404 is supplied as input to buffer 406. The output of buffer 406 is coupled to a positive 12 volts through resistor 408 and long call LED 410.

Signals appearing on line 326 at the output of tri-input OR gate 324 are applied to the base of NPN transistor 416 through resistor 412. The base of NPN transistor 416 is coupled to circuit ground and its emitter through resistor 414. The collector of NPN transistor 416 appearing on fault line 418 is coupled to a positive 12 volts through resistor 420 and fault LED 422. Additional circuitry associated with any additional channels of a vehicle detector monitor 10 comprising resistors 412, 414 and 420; NPN transistor 416; and fault LED 422 would be similarly connected to the inputs of QUAD input NOR gate 394.

The circuitry of vehicle detector monitor 10 may be reset by a signal appearing on external reset line 424 or the depression of reset switch 426 connecting reset line 140 to circuit ground through resistor 430. Resistor 428 couples external reset line 424 to a positive 12 volts. Additionally, reset line 140 is coupled to circuit ground through the parallel connected RC network comprising resistor 434 and capacitor 436. As shown, multiple outputs on reset line 140 may be supplied to multiple channels of a vehicle detector monitor 10.

A 60 Hz signal is input to clock 440 on power input line 438. Clock 440 has its reset line 442 connected to circuit ground. One output of clock 440 is supplied as one input to exclusive OR gate 448, and to its remaining input through resistor 446. The remaning input of exclusive OR gate 448 is coupled to circuit ground through capacitor 450. The output of exclusive OR gate 448 is supplied on pulse call line 184 for input to OR gate 190. A second output of clock 440 is furnished on line 100 for input to NOR gate 102. As depicted, the signals appearing on line 100 and pulse call line 184 may be supplied to a plurality of vehicle detector monitors 10.

DETAILED SYSTEM OPERATION

Long Call Mode of Operation

Upon receiving a call signal on call in line 126 for longer than 5 milliseconds, a logic low is sensed on line 122 as input to OR gate 124. The output of OR gate 124 on line 138 will then in turn follow this signal and change states from a logic high to a logic low. This signal transition is applied directly to exclusive OR gate 150 but is delayed for 10 milliseconds to its other input by the RC network comprising resistor 146 and capacitor 148. This imbalance of the arrival of these two signals to the inputs of exclusive OR gate 150 will produce a positive spike of 10 milliseconds on its output on line 152. This pulse is then transmitted from the input of AND gate 156, when enabled, through to its output on line 158. Line 158 is then input to one input of the enabled tri-input OR gate 160 through to its output on reset line 162. This logic high on reset line 162 to channel timer 170 will reset all the outputs on lines 174, 176 and 178 to a logic low independent of any clock pulse appearing on clock line 166.

The logic low of the output of OR gate 124 appearing on line 138 is also transmitted to one input of OR gate 164. When enabled, the input to OR gate 164 is coupled to its output on line 168 for application to one input of AND gate 214. This input will disable AND gate 214 and prevent the no call test from occuring.

The logic low of the output of OR gate 164 appearing on line 168 is also applied to one input of NOR gate 240. NOR gate 240 will invert the signal and produce a logic high on line 242 which in turn is transferred through to one input of tri-input OR gate 244. When enabled, the signal appearing on line 242 will be transferred through to the output on line 246 for application to one input of AND gate 248. When enabled, AND gate 248 will pass the signal through to its output to the base of NPN transistor 274 through resistor 278. This logic high turns on NPN transistor 274 producing a logic low on call out line 264 and illuminating channel call LED 260.

If the call signal on call in line 126 remains for 1.1 minutes, channel timer 170 will produce a logic high on line 174 and apply it to the input of the disabled AND gate 214. If the call signal remains for 6.82 minutes, a logic high is produced on lines 176 and 178, which in turn is applied to the inputs of AND gate 180. AND gate 180 in turn transfers its output on line 182 to a logic high. This logic high is then transmitted through tri-input OR gate 324 of the channel fault summing circuit to its output on line 326. This signal on line 326 turns on NPN transistor 416. The open collector of NPN transistor 416 transfers to a logic low and illuminates fault LED 422.

The logic high on the output of AND gate 180 appearing on line 182 is also applied to an input of QUAD input OR gate 404 and will produce a logic low on its output. This logic low is buffered through buffer 406 to illuminate long call LED 410.

The logic high on the output of tri-input OR gate appearing on line 326 is also applied to one input of AND gate 328 to enable the fault latch circuitry. This signal is also input to the fault summing circuitry comprising QUAD input NOR gate 394. The output of QUAD input NOR gate 394 transfers to a logic low and turns off NPN transistor 384 forcing the collector to a logic high thus deenergizing fault output relay 372.

No Call Mode of Operation

Upon receiving an absence of a call signal on call in line 126 for longer than 5 milliseconds, a logic high is sensed on the input of OR gate 124. The output of this now enabled OR gate 124 on line 138 will in turn follow this signal and change states from a logic low to a logic high. This signal transition is applied directly to exclusive OR gate 150 but is delayed for 10 milliseconds to the other input thereof by the RC network comprising resistor 146 and capacitor 148. This imbalance on the arrival of these two signals to exclusive OR gate 150 will produce a positive spike of 10 milliseconds on its output on line 152. This pulse is transmitted from the input of AND gate 156 through to its output on line 158 to the input of tri-input OR gate 160. When enabled, tri-input OR gate 160 passes the signal through to its output on reset line 162 to channel timer 170. Upon receiving this input on reset line 162, channel timer 170 will force the outputs on lines 174, 176 and 178 to a logic low independent of the clock pulse on clock line 166.

The logic high of the output of OR gate 124 on line 138 is also transmitted through the input of OR gate 164 to its output on line 168. This signal on line 168 is then applied to AND gate 214 which then allows the no call test at a predetermined time.

The logic high of the output of OR gate 164 appearing on line 168 is also applied to the input of NOR gate 240 which inverts the signal and produces a logic low on its output on line 242. This logic low is in turn transmitted through the input of tri-input OR gate 244 to its output on line 246. The signal, in turn, is then passed through the input of AND gate 248 to the base of NPN transistor 274 through resistor 278. This logic low applied to the base of NPN transistor 274 will turn the transistor off and place call out line 264 at a high impedance.

If the condition of not receiving any call signals continues for 1.1 minutes, channel timer 170 will produce a logic high on line 174 which is passed through to the output of AND gate 214 to its output on line 216. This logic high is transferred to exclusive OR gate 322 creating an input imbalance on this gate and forcing its output to a logic high state which is then applied to the input of exclusive OR gate 330 creating an input imbalance on exclusive OR gate 330. This imbalance forces the output of exclusive OR gate 330 to a logic high turning on NPN transistor 350 which energizes forced call relay 354.

The logic high of line 216 is also transferred directly to the input of AND gate 218 but is delayed to its other input through an RC network comprising resistor 222 and capacitor 224 connected to line 220. This imbalance of the arriving input signals produces on line 226 a 100 millisecond delay, thus creating a forced call timer.

The output of AND gate 214 on line 216 is also transmitted through the delay network of diode 228, resistor 230 and capacitor 232 to the input of OR gate 236. The output of OR gate 236 will change to a logic high which is in turn applied to the input on line 238 to NOR gate 240, thus forcing its output on line 242 to a logic low. This prevents the forced call signal from being delivered as a call signal on call out line 264.

Normally open contacts 358 of the forced call relay 354 connects in series between loop 12 and vehicle detector 14, a small but significant amount of impedance by means of coil 360. In the embodiment illustrated, coil 360 may be approximately 3 (microhenry). When forced call relay 354 energizes, normally open contact 358 short out this additional impedance and induce a call demand on vehicle detector 14. This call signal is sensed on call in line 126 and resets channel timer 170 as above described. This signal on call in line 126 also applies a logic low on line 168 for input to AND gate 214 as described above in the long call mode of operation. This forces the output of AND gate 214 on line 216 to a logic low stopping the forced call timer.

If the forced call timer is stopped before the 100 millisecond time delay created by resistor 222 and capacitor 224 can reach a charge potential on line 220 to AND gate 218 forcing its output on line 226 to a logic high, the logic low on the output of AND gate 214 appearing on line 216 is applied to one input of exclusive OR gate 322. This in turn returns the input signals of exclusive OR gate 322 to a balance condition. This will force the output of exclusive OR gate 322 to a logic low thus returning exclusive OR gate 330 input signal to a balance condition. This will force the output of exclusive OR gate 330 to a logic low turning on NPN transistor 350 and thus deenergizing forced call relay 354. This will remove the call demand on vehicle detector 14 thus returning line 138 to a logic high to reset channel timer 170 as described above when detecting an absence of a call. With channel timer 170 reset, the channel will initialize the no call test timing sequence again.

If the forced call timer is not stopped before 100 milliseconds, the time delay created by resistor 222 and capacitor 224 can reach a charge potential on line 220 of AND gate 218 sufficient to force its output on line 226 to a logic high. This logic high is applied to tri-input OR gate 324 which in turn produces a logic high on line 326 thereby de-energizing fault output relay 372 while simultaneously illuminating fault LED 422 as described in the long call mode. The logic high of line 226 is applied to the input of QUAD input NOR gate 396 and will produce a logic low on its output to buffer 398. This logic low is in turn transferred through resistor 400 to illuminate no call LED 402.

Internal Check Fault Mode of Operation

Upon sensing a call or an absence of a call signal on call in line 126, a logic low or a logic high respectively is found at the output of OR gate 164 on line 168. This signal is applied directly to the input of exclusive OR gate 282 and is also transmitted through the call signal output circuitry to line 280 to the other input of the exclusive OR gate 282. The imbalance of the arriving signals at exclusive OR gate 282 will produce a logic high on the output until the signals balance. If this logic high lasts longer than 25 milliseconds, the delay network comprising resistor 284, diode 286 and capacitor 290 will have reached a sufficient potential on line 288 to the input of NAND gate 292 to force a logic low on its output through capacitor 302 to line 304. This logic low, which is AC coupled through capacitor 302 and resistor 306, produces a logic low pulse which is applied to line 304 at the input of NAND gate 314. NAND gate 308 in latching configuration with NAND gate 314 comprise a standard configuration RS flip flop. This RS flip flop is negative edge sensitive and will produce a logic high on line 312, the Q output, whenever a transition from a logic high to a logic low is applied to line 304, the set input. The flip flop can be reset by applying a negative edge pulse to reset line 140 thus returning line 312 to a logic low. The logic high on line 312 is applied to the input of QUAD input NOR-gate 362 which in turn transmits a logic low from its output on line 364. This logic low is buffered through buffer 366 to illuminate internal fault LED 370. The logic high on line 312 is also transmitted to one input of tri input OR gate 324 to its output on line 326, which de-energizes fault output relay 372, illuminating fault LED 422 as above described in the long call mode of operation.

Channel Fault Mode of Operation

Upon initiation of a channel fault, a feedback signal will latch the channel in its fault condition until reset. When a fault has occurred, a logic high is applied to AND gate 328 on line 326 and de-energizes, thus de-energizing fault output relay 372 as described in long call. After fault output relay 372 has de-energized, a logic high appears on line 392 for input to AND gate 328 which in turn produces a logic high on its output on line 104. This logic high is applied to one input of NAND gate 316 and during a no call fault mode produces a logic low on its output for application to inverter 318, which in turn produces a logic high on its output on line 320. This logic high will balance the input signals appearing on lines 216 and 320 to exclusive OR gate 322 and return the output of exclusive OR gate 322 to a logic low thus de-energizing forced call relay 354 and removing the call demand from vehicle detector 14.

The logic high of line 104 is applied to the input of inverter 300 for inversion to a logic low at its output to NAND gate 292. This logic low is delayed by the RC network comprising resistor 298 and capacitor 296 for 50 milliseconds which is then applied on line 294 to NAND gate 292 thus disabling the internal check.

The logic high of line 104 is also applied to the input of OR gate 236 and produces a constant logic high on its output on line 238. This logic high on line 238 is in turn applied to the input of NOR gate 240 forcing its output on line 242 to a logic low preventing any call signals on call out line 264.

The logic high of AND gate 328 appearing on line 104 is also applied to the input of OR gate 164 forcing a logic high to remain on its output on line 168 preventing any change of the call signal status to reset the force call timer.

The logic high at the output of AND gate 328 on line 104 is also applied to the input of NOR gate 102 forcing its output on line 166 to remain at a logic low thus removing the clock to channel timer 170.

The logic high appearing at the output of AND gate 328 on line 104 is also applied to the input of inverter 172 producing a logic low on its output on line 154. This logic low is in turn applied to the input of AND gate 156 forcing its output on line 158 to remain at a logic low thus preventing any call signal transition to reset channel timer 170.

Finally, the logic high appearing at the output of AND gate 328 on line 104 is also applied to one input of AND gate 194 which enables the gate to transmit the selected synthetic call signal received from OR gate 190 through its input on line 192 to its output on line 196. The signal on line 196 is then passed through AND gate 198 to its output on line 212. This output appearing on line 212 is summed onto call out line 264 by way of tri-input OR gate 244.

Synthetic Call Signal Mode of Operation

Upon initiation of a fault, a synthetic call is transferred onto the call out line 264 as described above in the channel fault mode of operation. A selection of a pulsed synthetic signal or a constant synthetic signal is made by means of switch 186.

The pulsed synthetic call is produced by receiving a clock signal of a 500 millisecond pulse every 15 seconds from exclusive OR gate 448 on pulse call line 184. This signal is applied to an input of OR gate 190 and is transmitted through to its output on line 192 to the synthetic call control circuitry. The constant synthetic signal is produced by the closing of switch 186 which applies a logic high to the other input of OR gate 190 thus producing a constant logic high on its output on line 194.

Synthetic call disable line 210 is used to prevent the synthetic call signal after a fault has occurred. This is accomplished by applying a logic low on synthetic call disable line 210 and the input on line 200 to AND gate 198 holding the output thereof on line 212 at a logic low level.

Other System Modes of Operation

Reset switch 426 or external reset line 424 will reset all channels simultaneously in a multi channel vehicle detector monitor monitor 10. This is accomplished by applying on line 140 a logic low to one input of NAND gate 308 of the internal fault latch flip flop thus resetting the latch to its normal condition as described above in the internal fault check mode of operation. This logic low on line 140 is also applied to the input of inverter 142 producing a logic high on its output on line 144. This logic high is transmitted to the input of tri-input OR gate 160 through to its output on reset line 162, thus applying a logic high to the reset of channel timer 170. This resets channel timer 170 and removes the fault conditions.

By applying a logic low to the internal fault check test input on internal fault check line 250 as well as to the input of AND gate 248, a constant logic low is produced on its output to NPN transistor 274 thus preventing a call signal from being produced. By applying a call signal on call in line 126, the channel will go into the internal fault mode as described above in the internal check fault mode of operation. System check line 344 is used to place a forced call independent of channel timer 170. By applying a logic low to system check line 344 and the input to inverter 332 appearing on line 334, a logic high is produced on the output of inverter 332 for input to exclusive OR gate 330. Exclusive OR gate 330 in turn transmits the signal through resistor 346 to energize forced call relay 354.

Disable line 106 is used to select the channels desired to be operated in a multi-channel vehicle detector monitor 10. This is accomplished by applying a logic low on disable line 106 or by closing disable switch 118. This applies a logic low to the input of inverter 120 on input line 116 thus producing a logic high at its output on line 122. This logic high is transmitted through tri-input OR gate 160 to its output on reset line 162 which holds channel timer 170 at a constant reset condition independent of the clock input signal. A 60 Hz signal is supplied by the power supply to clock 440 on power input line 438. This signal is in turn divided down to a one pulse per second signal on line 100, and to a one pulse per 30 seconds on its other output to exclusive OR gate 488. The one pulse per second signal on line 100 is supplied as the main clock frequency to channel timer 170. The one pulse every 30 second signal is applied directly to exclusive OR gate 448 and through an RC network comprising resistor 446 and capacitor 450 to the other input of exclusive OR gate 448. This imbalance in the arrival of these signals will produce on pulse call line 184 a positive pulse of 500 milliseconds width every 15 seconds. This signal is used in the synthetic call signal circuitry as the repetition rate of the pulsed synthetic call signal.

What has been provided therefore is a fault detecting circuit and method for a vehicle detector system which provides a monitoring function of a vehicle detector and sensor and gives visual indications of fault conditions. Further, the circuit and method of the invention can detect shorted and open conditions in a roadway embedded vehicle sensor and disconnect a defective vehicle detector and sensor combination from a traffic controller. Moreover, the present invention can automatically supply a synthetic call signal to a traffic controller while providing for self-test function for internal faults.

While there have been described above the principles of this invention in conjunction with specific apparatus, it is to be clearly understood that this description is made only by way of example and not as a limitation to the scope of the invention.

What is claimed is:

1. A vehicle detector monitor coupling a vehicle detector output to a traffic controller input comprising:

means for receiving a call in signal from said vehicle detector output when a vehicle is detected;

means coupled to said receiving means for generating a call out signal in response to said call in signal;

means coupled to said receiving and generating means for comparing said call in and call out signals, said comparing means developing a first control signal when said call in and call out signals correspond, and a second control signal when said call in and call out signals do not correspond; and means for coupling said generating means to said traffic controller input in response to said first control signal, and means for disconnecting said generating means from said traffic controller input in response to said second control signal.

2. The vehicle detector monitor of claim 1 further comprising means for indicating a fault condition in response to said second control signal.

3. The vehicle detector monitor of claim 2 wherein said indicating means is visual.

4. The vehicle detector monitor of claim 3 wherein said indicating means is an LED.

5. A vehicle detector monitor having input and output terminals thereof comprising:

means for receiving a call in signal at said input terminal when a vehicle is detected, means for initiating a control timer when a call in signal becomes present at said input terminal, said control timer having a predetermined timing period such that a first control signal is produced while said call in signal remains present at said input terminal during said timing period and a second latching control signal is produced when said call in signal remains present at said input terminal in excess of said timing period, and means operably coupling said input and output terminals for passing said call in signal to said output terminal in response to said first control signal and disconnecting said call in signal from said output terminal in response to said second latching control signal.

6. The vehicle detector monitor of claim 5 further comprising means for manually reinitiating said timer.

7. The vehicle detector monitor of claim 5 further comprising means for generating a synthetic call in signal for input to said output terminal in response to said second control signal.

8. A vehicle detector monitor having input and output terminals thereof comprising:

means for receiving a call in signal at a said input terminal when a vehicle is detected, means for initiating a control timer when a call in signal become present at said input terminal, said control timer having a predetermined timing period such that a first control signal is produced while said call in remains present at said input terminal during said timing period and a second latching control signal is produced when said call in signal remains present at said input terminal in excess of said timing period, means operably coupled said input and output terminals for passing said call in signal to said output terminal in response to said first control signal and disconnecting said call in signal from said output terminal in response to said second latching control signal, and means for generating a synthetic c ll in signal for input to said output terminal in response to said second control signal wherein said synthetic call in signal is a one of a constant signal level and a pulsed signal of predetermined pulse duration and frequency.

9. The vehicle detector monitor of claim 8 further comprising means for manually disabling said synthetic call in signal.

10. The vehicle detector monitor of claim 7 wherein said synthetic call in signal is a pulsed signal of predetermined pulse duration and frequency.

11. The vehicle detector monitor of claim 10 wherein said pulsed signal is substantially a 500 millisecond signal every 15 seconds.

12. The vehicle detector monitor of claim 5 wherein said input terminal is coupled to a vehicle detector and said output terminal is coupled to a traffic controller.

13. The vehicle detector monitor of claim 5 further comprising means for visually indicating the presence of said second control signal.

14. The vehicle detector monitor of claim 13 wherein said visually indicating the means comprises an LED.

15. The vehicle detector monitor of claim 5 further comprising means for manually inducing said second latching signal.

16. The vehicle detector monitor of claim 5 further comprising means for manually overriding said second latching signal.

17. A vehicle detector monitor having input, output and control terminals comprising:

means for receiving a call in signal at said input terminal said call in signal resulting from detection of a vehicle, means for initiating a first control timer when said call in signal is no longer present at said input terminal, said first control timer having a first predetermined timing period such that a first control signal is produced while said call in signal remains not present at said input terminal during said first predetermined timing period, and a second control signal is produced when said call in signal is continuously not present at said input terminal in excess of said first predetermined timing period, means for operably coupling said input and output terminals in response to said first control signal, means for introducing a sensor simulator at said control terminal and initiating a second control timer in response to said second signal, said sensor simulator providing an activation of a call in signal without detection of a vehicle, said second control timer having a second predetermined timing period such that said first timer will be automatically reinitiated when said call in signal becomes present during said second predetermined timing period and a latching control signal is produced when said call in signal remains not present at said input terminal in excess of said second predetermined timing period, and means for operably disconnecting said input and output terminals in response to said latching control signal.

18. The vehicle detector monitor of claim 17 further comprising means for manually reinitiating said first control timer.

19. The vehicle detector monitor of claim 17 further comprising means for generating a synthetic call in signal for input to said output terminal in response to said latching control signal.

20. The vehicle detector monitor of claim 19 further comprising means for manually disabling said synthetic call in signal.

21. The vehicle detector monitor of claim 19 wherein said synthetic call in signal is a constant signal level.

22. The vehicle detector monitor of claim 19 wherein said synthetic call in signal is a pulsed signal of predetermined pulse duration and frequency.

23. The vehicle detector monitor of claim 22 wherein said pulsed signal is substantially a 500 millisecond signal every 15 seconds.

24. The vehicle detector monitor of claim 17 wherein said input and control terminals are connected to a vehicle detector and said output terminal is connected to a traffic controller.

25. The vehicle detector monitor of claim 17 further comprising means for visually indicating the presence of said latching control signal.

26. The vehicle detector monitor of claim 25 wherein said visually indicating means comprises an LED.

27. The vehicle detector monitor of claim 17 further comprising means for manually inducing said latching control signal.

28. The vehicle monitor of claim 17 further comprising means for manually overriding said latching control signal.

29. The vehicle detector monitor of claim 17 wherein said call in signal is determined by detector apparatus including a loop, wherein said sensor simulator comprises any device that modifies the impedance in said loop.

30. A method for coupling a vehicle detector output to a traffic controller input comprising the steps of:

receiving a call in signal from said vehicle detector output when a vehicle is detected, generating a call out signal in response to said call in signal, comparing said call in and call out signals, developing a first control signal when said call in and call out signals correspond and a second control signal when said call in and call out signals do not correspond, coupling said call out signal to said traffic controller input in response to said first control signal, and disconnecting said call out signal from said traffic controller input in response to said second control signal.

31. The method of claim 30 further comprising the step of indicating a fault condition in response to said second control signal.

32. The method of claim 31 wherein said step of indicating is carried out by means of an LED.

33. A method for a vehicle detector monitor having input and output terminals thereof comprising the steps of:

receiving a call in signal at said input terminal when vehicle is detected by a vehicle detector;

initiating operation of a control timer when a call in signal becomes present at said input terminal, said control timer having a predetermined timing period, producing a first control signal while said call in signal remains present at said input terminal during said timing period and a second latching control signal when said call in signal remains present at said input terminal in excess of said timing period, passing said call in signal to said output terminal in response to said first control signal, and disconnecting said call in signal from said output terminal in response to said second latching control signal.

34. The method of claim 33 further comprising the step of manually reinitiating said timer.

35. A method for a vehicle detector monitor having input and output terminals thereof comprising the steps of receiving a call in signal at said input terminal, said call in signal generated when a vehicle is detected, initiating a control timer when a call in signal becomes present at said input terminal, said control timer having a predetermined timing period, producing a first control signal while said call in signal remains present at said input terminal during said timing period and a second latching control signal when said call in signal remains present at said input terminal in excess of said timing period, passing said call in signal to said output terminal in response to said first control signal, disconnecting said call in signal from said output terminal in response to said second latching control signal, and generating a synthetic call in signal for input to said output terminal in response to said latching control signal.

36. The method of claim 33 fruther comprising the step of visually indicating the presence of said second latching control signal.

37. A method for a vehicle detector monitor having input, output and control terminals comprising the steps of:

receiving a call in signal at said input terminal, said call in signal indicating detection of a vehicle;

initiating a first control timer when said call in signal is no longer present at said input terminal, said first control timer having a first predetermined timing period, producing a first control signal while said call in signal remains not present at said input terminal during said first predetermined timing period and a second control signal when said call in signal is continuously not present at said input terminal in excess of said first predetermined timing period, operably coupling said input and output terminals in response to said first control signal, introducing a sensor simulator at said control terminal and initiating a second control timer in response to said second control signal, said sensor simulator activating a call in signal without detection of a vehicle, said second control timer having a second predetermined timing period, automatically reinitiating said first timer when said call in signal becomes present during said second predetermined timing period and producing a latching control signal when said call in signal remains not present at said input terminal in excess of said second predetermined timing period, and operably disconnecting said input and output terminals in response to said latching control signal.

38. The method of claim 37 further comprising the step of generating a synthetic call in signal for input to said output terminal in response to said latching control signal.

39. A vehicle detector monitor coupling a vehicle detector output to a traffic controller input comprising:

means for receiving a signal from said vehicle detector output when said vehicle detector detects a vehicle and for generating a signal in response to the received signal, means coupled to said receiving and generating means for comparing said signals and for developing at least one control signal, and means for selectively coupling or decoupling said receiving and generating means to said traffic controller input in response to said control signal.

40. A method for coupling a vehicle detector monitor output to a traffic controller input comprising the steps of:

receiving a signal by said vehicle detector monitor from vehicle detector output when said vehicle detector detects a vehicle and generating a signal by said vehicle detector monitor in response to said receiving signal;

comparing said received and generated signals;

generating a control signal by said vehicle detector monitor in response to said comparing step; and selectively coupling or decoupling said vehicle detector output to said traffic controller in response to said control signal.

* * * * *